United States Patent [19]

Locke

[11] Patent Number: 4,825,542

[45] Date of Patent: May 2, 1989

[54] ELECTRIC DRY SHAVER

[75] Inventor: David R. Locke, Bridgeport, Conn.

[73] Assignee: Remington Products, Inc., Bridgeport, Conn.

[21] Appl. No.: 9,389

[22] Filed: Jan. 30, 1987

[51] Int. Cl.[4] ..... R26B 19/04

[52] U.S. Cl. ..... 30/43.92; 30/346.51

[58] Field of Search ..... 30/43, 43.2, 43.91, 30/43.92, 346.51

[56] References Cited

U.S. PATENT DOCUMENTS

| | | | |
|---|---|---|---|
| 2,908,970 | 10/1959 | Braun et al. | 30/43.92 X |
| 3,269,008 | 8/1966 | Messinger et al. | 30/43.2 X |
| 3,401,454 | 9/1968 | Godefroy | 30/43.91 |
| 3,824,687 | 7/1974 | Baumann | 30/43.92 |
| 3,872,586 | 3/1975 | Oguchi | 30/43.91 |
| 4,009,518 | 3/1977 | Locke et al. | 30/43.92 |
| 4,271,590 | 6/1981 | Ernst et al. | 30/43.92 |

*Primary Examiner*—Frank T. Yost
*Assistant Examiner*—Michael D. Folkerts

[57] ABSTRACT

An electric dry shaver is disclosed having a demountable hair pocket. An outer foil cutter member is supported by a hair pocket engaging means. When the hair pocket is mounted to the shaver, the foil is captivated to the hair pocket by an inner cutter carrier whose lateral dimension limits lateral movement of the foil on the engaging means.

6 Claims, 2 Drawing Sheets

ELECTRIC DRY SHAVER

BACKGROUND OF THE INVENTION

1. Field of the Invention

This invention relates to electric dry shavers. The invention relates more particularly to an improved arrangement for securing an outer cutter member of an electric dry shaver.

2. Description of the Prior Art

Electric dry shavers generally include a hand-held housing and a cutter head, the housing being manipulated for advancing the cutter head in contact with a user's face or other body site at which hair is to be shaved. The cutter head includes an outer, stationary, apertured cutter member and an inner, reciprocating cutter member which operates in shearing engagement with the outer cutter member. An electric motor is positioned in the housing and is mechanically coupled to the cutter head for imparting reciprocating motion to the inner cutter member. A user's facial hairs which extend through the apertures in the outer cutter member are thereby sheared by the cutter members.

In a form of electric dry shaver with which this invention is concerned, the outer cutter member comprises a relatively thin, flexible, apertured foil which is supported on a hair pocket body. The hair pocket body is adapted to be mounted to and demounted from the shaver housing. When so mounted, the hair pocket body positions the foil cutter in shearing engagement with the inner reciprocating inner cutter. As the outer cutter is advanced along a user's face, the flexible outer cutter will experience inward forces of varying magnitude which cause it to flex and yield. It is mounted to the hair pocket so as to restrain the metal foil at its edges during such use.

In addition to restraining the outer cutter during use, it is also desirable for the outer cutter itself to be readily demounted from the hair pocket body for enabling a thorough cleaning of the hair pocket after substantial usage and to facilitate replacement of the foil cutter after wear. To satisfy these requirements, edge bars are mounted to opposite extending edges of the flexible foil. These bars include cutouts formed for engaging inwardly extending support bosses on the hair pocket body. The foil is thus supported in a desired position relative to the inner cutter. Generally speaking, an inner cutter used with a flexible outer foil cutter comprises a longitudinal extending array of cutter discs which are mounted on a cutter carrier. The cutter carrier positions the inner cutter discs adjacent an inner surface of the outer cutter foil.

While the bars are supported on the hair pocket body by the aforementioned bosses, various additional means have also been provided for securing the foil bar and thus the foil cutter to the hair pocket body. In one arrangement clips are provided. These clips are integrally molded in the hair pocket or alternatively are independent members. In either case, the clips add additional cost to the shaver and introduce complexity in assembly of the bars to the hair pocket body. In those cases in which clips are not used, the mounting bosses may include reentrant segments which inhibit escape of the cutter bar from the bosses. This arrangement is relatively difficult to assemble and disassemble.

SUMMARY OF THE INVENTION

Accordingly, it is an object of this invention to provide an improved arrangement for securing an outer foil cutter member of an electric dry shaver to a hair pocket.

Another object of the invention is to provide an electric dry shaver having means for securing the outer foil cutter to a hair pocket which reduces the complexity and cost of construction and assembly.

A further object of the invention is to provide an electric dry shaver wherein a means for securing an outer foil cutter to the hair pocket facilitates removal of the foil from the hair pocket body.

In accordance with features of the invention, an improved electric dry shaver comprises a shaver housing which supports an elongated cutter carrier having a longitudinal array of cutter blades mounted thereto. A means from imparting reciprocating motion to the array is provided. A demountable hair pocket body is supported on the housing. The hair pocket body supports a flexible, apertured, outer cutter member in cutting engagement with said inner blade array. An engaging means is positioned on the hair pocket body for engaging the flexible outer cutter member adjacent opposite edges of the member. The engaging means permits relative motion of the foil edges therewith. The cutter carrier has a width which is dimensioned for captivating the apertured outer cutter member on the engaging means.

BRIEF DESCRIPTION OF THE DRAWINGS

These and other objects and features of the invention will become apparent with reference to the following specifications and to the drawings wherein.

DETAILED DESCRIPTION

Figure 1:
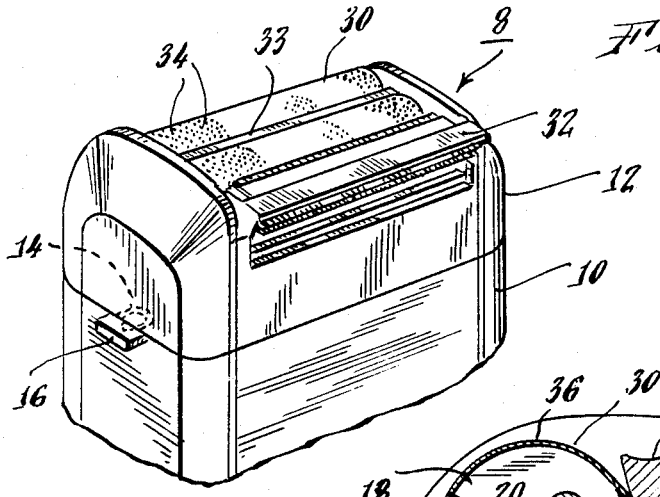
FIG. 1 is a fragmentary perspective view of an electric dry shaver constructed in accordance with features of this invention.
Figure 2:
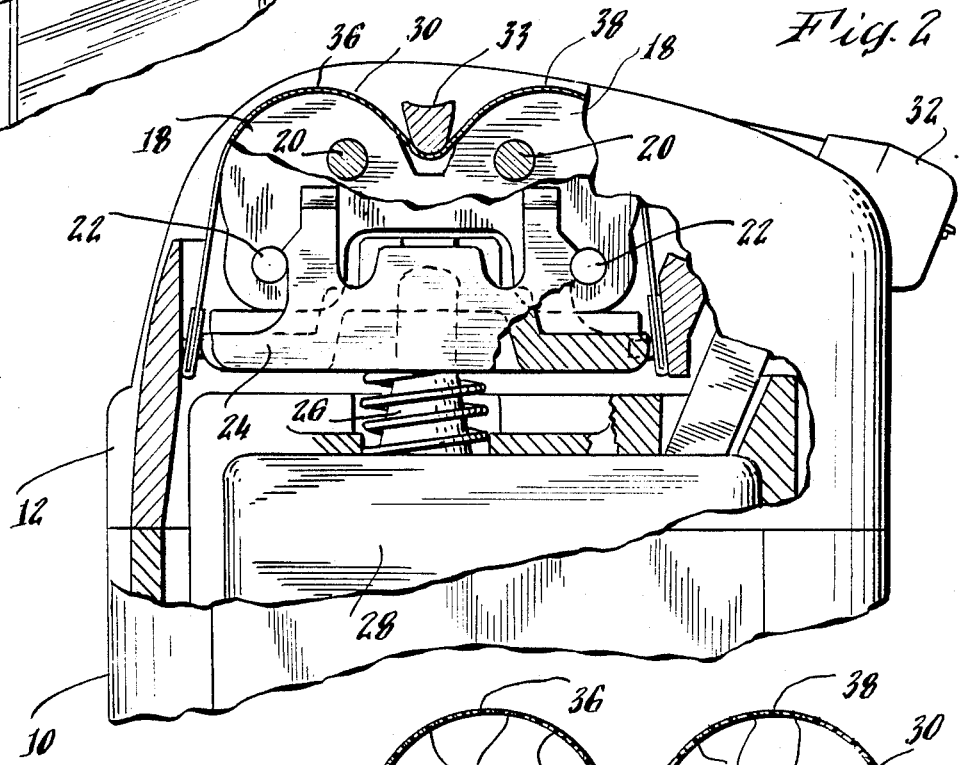
FIG. 2 is an enlarged, side elevation view of the electric dry shaver of FIG. 1, partly cut away and partly in section.
Figure 3:
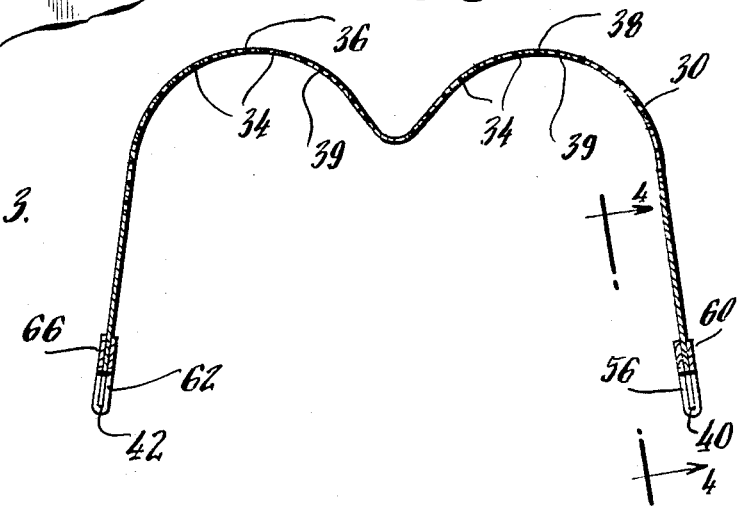
FIG. 3 is an enlarged, side elevation view of an outer, flexible, foil cutter used with the electric dry shaver of FIG. 2.
Figure 4:
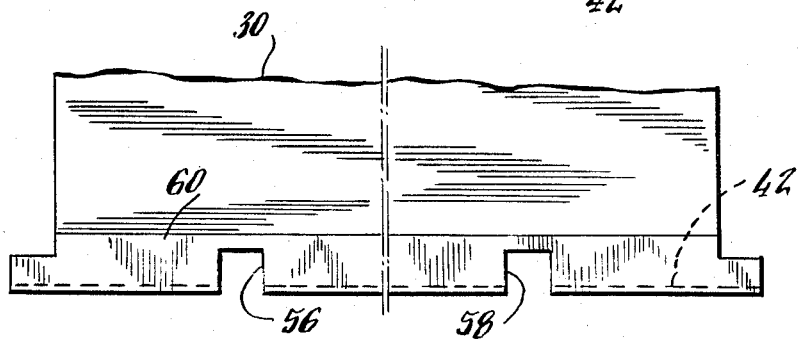
FIG. 4 is a view taken along the lines 4—4 of FIG. 3.

Referring now to the drawings, an electric dry shaver 8 is shown to include a housing 10 and a hair pocket body 12 which is demountably supported on the housing 10. As illustrated in FIG. 1, the hair pocket body 12 includes an integral segment which is engaged by a clip 14 of the housing 10. When so positioned and engaged, the hair pocket body 12 is locked to the housing 10. By depressing a release push button 16, the clip 14 releases the hair pocket body 12 and it can be removed from the housing 10.

Housing 10 supports an inner cutter comprising an array of longitudinally extending metal cutter blades 18 which are mechanically intercoupled and aligned by elongated upper rods 20 and lower rods 22. This array is mounted to a polymer plastic carrier body 24. An oscillator member 26 engages the body 24 and couples it to an electric motor 28 for imparting reciprocating motion to the cutter carrier body 24 and to the cutter blade array. A battery source of electric energy not illustrated, is coupled to and decoupled from the motor 28 by a manually actuated switch, also not illustrated.

Hair pocket 12 supports a flexible, outer apertured foil cutter 30 and a hair trimmer assembly 32. The foil cutter 30 is flexible and has a generally rectangular shaped configuration when it is extended prior to mounting to the hair pocket. Upon mounting, as described hereinafter, the foil 30 is depressed along its length by a bar 33 which establishes parallel, arcuate shaped, elongated cutter surfaces 36 and 38. Bar 33 extends longitudinally along the length of hair pocket body 12. The foil 30 is preferably made of nickel by a suitable electro-forming process. When hair pocket body 12 is mounted to the housing 10, an inner surface 39 of the foil 30 is positioned adjacent to and in cutting engagement with the array of inner cutter blades 18. A user's hairs extending through foil apertures 34 are sheared by the relative cutting motion between the inner and outer cutters. The foregoing describes an electric dry shaver of a type which is known in the art and which is shown, for example, in U.S. Pat. No. 4,089,109.

Figure 5:
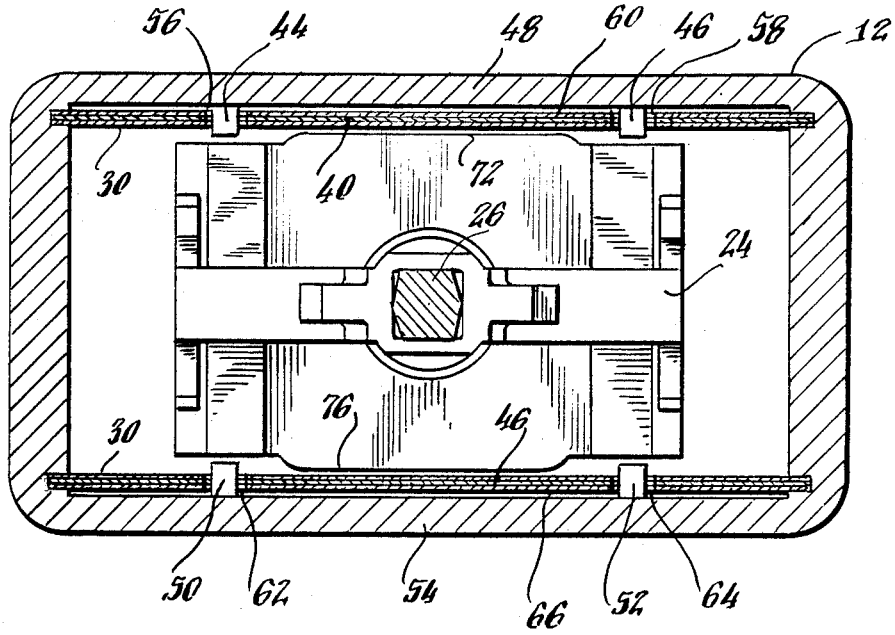
FIG. 5 is a plan view in section of the electric dry shaver of FIG. 2; and, FIG. 6 is an enlarged, fragmentary view of a portion of the shaver of FIG. 5.
Figure 6:
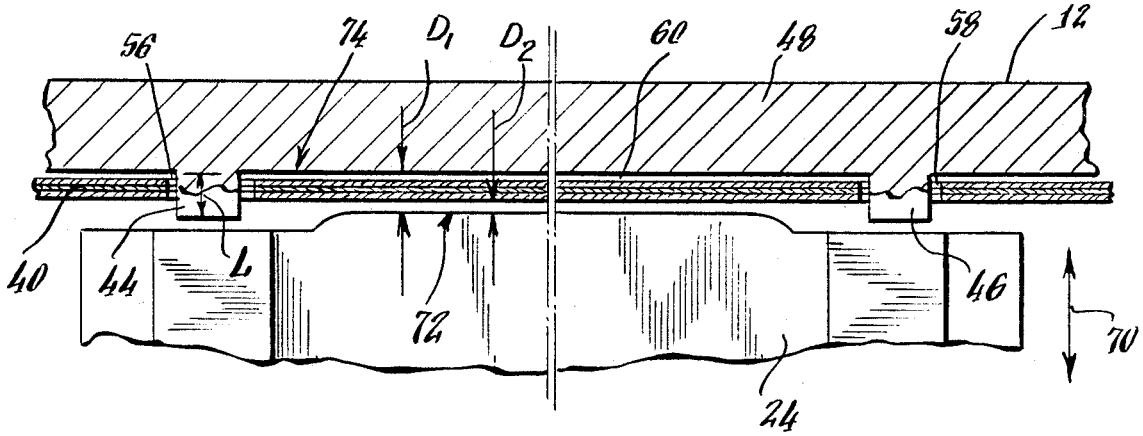

An outer cutter engaging means is provided and is formed in the hair pocket body 12 for engaging and supporting the outer cutter 30 adjacent its first and second opposite edges 40 and 42, respectively. As best seen in FIGS. 5 and 6, the engaging means in a preferred embodiment comprises first and second spaced apart bosses 44 and 46, respectively which are integrally formed in a first wall segement 48 of the hair pocket body 12, and, spaced apart bosses 50 and 52 which are also integrally formed in a second opposite wall segment 54 of the hair pocket 12. The bosses 44 and 46 engage cutouts 56 and 58, respectively which are formed in and adjacent to the edge 40 of the outer cutter foil, and, in an elongated stiffner and mounting bar 60 which sandwiches the edge 40 therebetween. The bar 60 is mounted to the edge by any suitable means including mechanical compression and dimpling, by spot-welding, etc. Similarly, the bosses 50 and 52 engage cutouts 62 and 64 formed in the foil 30 adjacent edge 42, and, in a support stiffner bar 66 which is similarly mounted to the edge 42 of the outer cutter foil 30. As best seen in FIG. 6, the outer cutter edge 40 and the support stiffner bar 60 are free to move in a lateral direction 70. The sandwiched edge 40 and the bar 60 encounter no constraint in lateral movement until such time as they may, during usage and application of exterior forces, extend inwardly along the bosses 44 and 46 to engage an edge 72 of the cutter carrier 24. The cutter carrier, 24 has a width which is dimensioned for captivating the bar 60 and the sandwiched edge 40 on the bosses 44 and 46, respectively. A spacing $D_1$ between the cutter carrier edge 72 and the inner wall surface 74 of the hair pocket wall segment 48 has a maximum value which is equal to the length L of the lateral extension of the bosses 44 and 46 from the surface 74 plus the thickness of the bar 60. With this spacing, the bar 60 during its lateral motion in the direction 70 will contact the edge 72 of the cutter carrier 24 before it can fully escape from the bosses 44 and 46. The cutter carrier 24 therefore operates to loosely captivate the bar 66 and the sandwiched edge 40 of the cutter foil 30 on the engaging means.

It is preferable that the distance between the bar 60 and the edge 72 of the cutter carrier 24 be relatively small to inhibit substantial movement of this outer cutter segment during application of the cutter head to a user's face. On the other hand, a sufficient distance $D_2$ should be provided to avoid continuous frictional engagement between the bar 60 and the edge 72 of the cutter carrier. As illustrated in FIG. 6, the cutter carrier 24 has a width which decreases in the vicinity of the bosses 44 and 46 and increases in the space therebetween to provide the desired captivation. In practice, a spacing $D_2$ of about 0.008 inches has been found to provide satisfactory operation. An opposite edge 76 of the cutter carrier 24 and the bosses 50 and 52 are similarly configured and dimensioned for captivating the bar 60 on the bosses 50 and 52.

From the above, it will be appreciated that the engaging means permits lateral movement of the bar and edge in the direction 70 while also captivating the same when the hair pocket body 12 is mounted to the housing 10. Assembly and cost are relatively simple. Upon removal of the hair pocket body 12 from the housing 10, the captivating spatial relationship between the cutter carrier 24, the bars 60 and 66 and the bosses no longer exists and the outer carrier foil 30 can then be readily removed from the engaging means.

While there has been described a particular embodiment of the invention, it will be apparent to the those skilled in the art that variations may be made thereto without departing from the spirit of the invention and the scope of the appended claims.

What is claimed is:

1. An improved electric dry shaver comprising:

a. A shaver housing;

b. Said housing supporting an elongated, cutter carrier body having an inner, longitudinal array of cutter blades mounted thereto;

c. Means for imparting reciprocating motion to said body in said longitudinal direction;

d. A hair pocket body demountably supported on said housing;

e. Said hair pocket body supporting a flexible, apertured outer cutter in cutting engagement with said inner cutter blade array;

f. Said flexible, outer cutter having first and second opposite edges thereof;

g. An engaging means formed in said hair pocket body for engaging and supporting said flexible apertured cutter adjacent said first and second edges;

h. Said outer cutter edges free to move in a lateral direction relative to said engaging means;

i. Said cutter carrier having edges thereof spaced a distance from said first and second cutter edges for limiting lateral movement of said flexible, outer cutter edges relative to said engaging means and captivating said flexible apertured cutter member at said engaging means.

2. The improved electric dry shaver of claim 1 wherein said cutter carrier has a body width thereof which limits said lateral movement of said edges of said flexible, apertured cutter member.

3. An improved electric dry shaver comprising:

a. A shaver housing;

b. Said housing supporting an elongated, cutter carrier body having an inner, longitudinal array of cutter blades mounted thereto;

c. Means for imparting reciprocating motion to said body in said longitudinal direction;

d. A hair pocket body demountably supported on said housing;

e. Said hair pocket body supporting a flexible, apertured outer cutter in cutting engagement with said inner cutter blade array;

f. Said flexible, outer cutter having first and second opposite edges thereof;

g. Said hair pocket including a wall thereof having an inner surface and a support boss means formed in said hair pocket body for engaging and supporting said flexible apertured cutter adjacent said first and second edges;

h. Said boss means extending laterally inwardly from said surface and having a length thereof and distal edges thereof and enabling free lateral movement of said cutter edges along said length; and i. Said cutter carrier having a body width which is dimensioned to provide carrier body edges thereof which are spaced a distance from said first and second cutter edges for inhibiting lateral movement of said cutter member edges beyond said distal edges of said boss means.

4. The improved electric dry shaver of claim 2 including first and second bar members mounted to said first and second edges of said outer cutter member, said bar members including cutouts formed therein for engaging said support boss means.

5. The improved electric dry shaver of claim 4 wherein said hair pocket body includes first and second spaced apart bosses extending inwardly from said first and second inner surfaces of said walls, said bars having cutouts formed along the length of each in alignment with said bosses for enabling positioning of said bosses in said cutouts, and said cutter carrier dimension has a width which extends inwardly toward said wall surfaces for a distance at least coincident with a distal end of said bosses.

6. The improved electric dry shaver of claim 3 wherein said boss means comprises first and second based apart bosses and said cutter carrier body is configured for engaging said edges of said foil cutter edges at a location intermediate said bosses.

* * * * *